US008549829B2

(12) United States Patent
Song et al.

(10) Patent No.: US 8,549,829 B2
(45) Date of Patent: Oct. 8, 2013

(54) SILVER YARN, PLIED YARN SILVER YARN, FUNCTIONAL FABRIC USING SAME, AND METHOD FOR PRODUCING SAME

(75) Inventors: Yong Sul Song, Seoul (KR); Moon Hoe Kim, Gimpo-si (KR); Min Ho Won, Gimpo-si (KR)

(73) Assignee: Amogreentech Co., Ltd. (KR)

( * ) Notice: Subject to any disclaimer, the term of this patent is extended or adjusted under 35 U.S.C. 154(b) by 61 days.

(21) Appl. No.: 13/321,328

(22) PCT Filed: May 20, 2010

(86) PCT No.: PCT/KR2010/003181
§ 371 (c)(1),
(2), (4) Date: Nov. 18, 2011

(87) PCT Pub. No.: WO2010/134762
PCT Pub. Date: Nov. 25, 2010

(65) Prior Publication Data

US 2012/0060963 A1 Mar. 15, 2012

(30) Foreign Application Priority Data

May 20, 2009 (KR) ..... 10-2009-0044003

(51) Int. Cl.
*D02G 3/04* (2006.01)
*D02G 3/36* (2006.01)

(52) U.S. Cl.
USPC ..... 57/238

(58) Field of Classification Search
USPC ..... 57/210, 212, 230, 236, 238
See application file for complete search history.

(56) References Cited

U.S. PATENT DOCUMENTS

| | | | | |
|---|---|---|---|---|
| 3,822,543 | A * | 7/1974 | Edagawa et al. | 57/5 |
| 5,525,423 | A * | 6/1996 | Liberman et al. | 428/370 |
| 6,190,407 | B1 * | 2/2001 | Ogle et al. | 623/1.51 |
| 7,135,227 | B2 * | 11/2006 | Karayianni et al. | 428/370 |
| 7,926,254 | B2 * | 4/2011 | Karayianni et al. | 57/310 |
| 2003/0051458 | A1 | 3/2003 | Kim | |
| 2004/0237494 | A1 * | 12/2004 | Karayianni et al. | 57/212 |

(Continued)

FOREIGN PATENT DOCUMENTS

| | | |
|---|---|---|
| KR | 10-2001-0100844 | 11/2001 |
| KR | 10-2003-0023946 | 3/2003 |

(Continued)

OTHER PUBLICATIONS

International Search Report—PCT/KR2010/003181 dated Jan. 31, 2011.

*Primary Examiner* — Shaun R Hurley
(74) *Attorney, Agent, or Firm* — Cantor Colburn LLP

(57) ABSTRACT

The present invention relates to plied silver yarn using silver wire as thread, wherein the silver wire is entirely made of silver (Ag) or a silver alloy, to achieve antimicrobial properties and conductivity, as well as to functional fabric using same and to a method for producing same. The plied silver yarn of the present invention uses, as a core yarn, any one of at least one strand of silver wire and fiber yarn made from natural fiber or synthetic fiber, and uses the other as winding yarn covering the core yarn, wherein said one strand of silver wire is produced by casting a silver alloy containing pure silver or copper into a wire rod through directional solidification, and making the wire rod into a microfiber having a diameter of 0.015 to 0.05 mm through a pulling process.

4 Claims, 6 Drawing Sheets

(56) References Cited

U.S. PATENT DOCUMENTS

| | | | | |
|---|---|---|---|---|
| 2007/0148449 | A1* | 6/2007 | Winterhalter | 428/362 |
| 2008/0128054 | A1* | 6/2008 | Johns | 148/516 |
| 2008/0217807 | A1* | 9/2008 | Lee et al. | 264/172.18 |
| 2009/0062726 | A1* | 3/2009 | Ford et al. | 604/57 |
| 2009/0081268 | A1* | 3/2009 | Pianezza | 424/404 |
| 2009/0214848 | A1* | 8/2009 | Sands et al. | 428/292.1 |
| 2010/0003496 | A1* | 1/2010 | Dias et al. | 428/222 |
| 2010/0032486 | A1* | 2/2010 | Tasaki et al. | 235/492 |
| 2010/0080966 | A1* | 4/2010 | Lee | 428/203 |
| 2010/0101007 | A1* | 4/2010 | Carraro | 2/456 |
| 2011/0047957 | A1* | 3/2011 | Richard | 57/236 |
| 2011/0291058 | A1* | 12/2011 | Kunishi et al. | 252/514 |
| 2012/0041483 | A1* | 2/2012 | Indiano | 606/228 |

FOREIGN PATENT DOCUMENTS

| | | |
|---|---|---|
| KR | 10-2003-0091574 | 12/2003 |
| KR | 10-2004-0078826 | 9/2004 |
| KR | 10-2006-0047094 | 5/2006 |
| KR | 10-0588763 | 6/2006 |
| KR | 10-2006-0122543 | 11/2006 |
| KR | 10-0688899 | 2/2007 |
| KR | 10-0706669 | 4/2007 |
| KR | 10-2008-0082092 | 9/2008 |

* cited by examiner

SILVER YARN, PLIED YARN SILVER YARN, FUNCTIONAL FABRIC USING SAME, AND METHOD FOR PRODUCING SAME

TECHNICAL FIELD

The present invention relates to a silver yarn, plied yarn silver yarn, functional fabric using same, and method for producing same, and more particularly, to a plied silver yarn, a functional fabric using the same, and a manufacturing method of the same that can provide anti-bacterial effect and conductivity by using a silver wire (Ag wire), which is made of silver (Ag) or silver alloy, as thread.

BACKGROUND ART

In general, silver (Ag) provides a strong sterilizing effect and deodorizing effect, and is also excellent at preventing electromagnetic waves or geopathic stress. Moreover, it is also well-known that silver (Ag) is excellent at radiating anions and far-infrared rays and provides strong anti-bacterial and antimycotic effects. Furthermore, silver (Ag) is known as one of essential elements to boost immunity in the body. It is also well-known that silver (Ag) ions prevent functions of enzymes during oxygen metabolism of bacterium or germs and kill pathogenic organisms as strong catalysts after being easily absorbed into the human body.

Additionally, silver (Ag) has been widely used as an antidote because having excellent detoxifying properties, and has been used as silver spoons or silverware at Court because being discolored due to neutralization or absorption with heavy metals or various noxious ingredients.

In connection with records on effects of silver, Bencao Gangmu, which is a traditional Chinese medicinal book, tells that silver extends a user's life because it makes the five viscera easy, makes mind and body stable, drives evil strength out, and makes the user feel refreshed. Moreover, Dongeui-bogam, which is a traditional Korean medicinal book, tells that silver is effective against mental diseases, such as epileptic fit and convulsion, and female disorders, such as fluor genitalis.

Conventional methods for manufacturing silver wires or conductive fibers are generally divided into: a thread mixing method of putting and mixing powder of fine silver nano-particles into ingredients of thread and spinning the mixture in such a way that silver particles are impregnated into the thread; and a coating method of coating the surface of a woven fabric or thread with silver using a binder.

First, for the thread mixing method, Korean Patent No. 613,189 discloses a method of manufacturing silver nano synthetic fibers. As shown in FIG. 1, the method of manufacturing silver nano synthetic fibers includes the steps of: (S100) stabilizing silver nano-particles through preprocessing and coating the surface of the silver nano-particles with polymer to prevent silver nano-particles from getting together; (S200) drying material polymerization chips and mixing the preprocessed silver nano-particles with the dried chips; and (S300) melting and spinning the material polymerization chips to which the preprocessed silver nano-particles are mixed to thereby obtain silver nano synthetic fiber yarns on which the silver nano-particles are dispersed evenly.

The step (S100) of preprocessing the silver nano-particles includes the steps of: (S110) coating the silver nano-particles with silicon oxide to stabilize the silver nano-particles; and (S120) coating the surfaces of the silver nano-particles, which are coated with silicon oxide, with polymer.

The method of manufacturing silver nano synthetic fibers is one of various kinds of the thread mixing method, and when being applied to thread, especially, in case of synthetic fiber thread, includes the steps of putting and mixing powder of fine silver nano-particles into ingredients of thread and spinning the mixture in such a way that silver particles are impregnated into the thread.

However, the method has a difficulty to evenly disperse silver particles to the thread, and is deteriorated in efficiency compared with an added amount of silver because it cannot show the inherent properties of silver in case of silver particles which do not protrude to the interior surface of the thread even though the silver particles are dispersed evenly. Moreover, when the silver impregnated amount is increased during spinning of the thread, the thread is not spun smoothly, and hence, there may occur defects such as break of the thread. In case of natural materials such as cotton besides the synthetic fiber thread, there is a limitation in use because silver cannot be impregnated into the natural materials.

Furthermore, silver fiber obtained through the thread mixing method is deteriorated in anti-electromagnetic effect and conductivity in an aspect of electrical characteristics, and just synthetic fiber thread including polyester can achieve the anti-electromagnetic effect and conductivity, but in this instance, it is difficult to provide a good silver effect because the silver impregnated amount is very small.

As a prior art according to the thread mixing method, Korean Patent No. 573,029 entitled "silver fiber and method of producing the same" discloses a method of producing thread by mixing polymer and silver particles and spinning the mixture through a nozzle. Silver particles are dispersed evenly inside the thread obtained through the producing method, but the method also has the same problem as mentioned above.

Furthermore, Korean Patent No. 588,763 discloses a method of producing anti-bacterial fiber containing silver nano-particles and anti-bacterial fiber produced through the method. In Korean Patent No. 588,763, the anti-bacterial fiber produced through the method contains silver nano-particles evenly dispersed inside a polymer without cohesion by adding silver nano-particle colloidal solution to the preheated polymer and removing moisture during rotation. However, the method also has the same problems as the above because the silver nano-particles and the polymer are mixed and spun together.

Meanwhile, as a prior art in relation with the coating method, Korean Patent Laid-open No. 2004-78826 discloses a method of producing functional fiber containing nonferrous metals. In Korean Patent Laid-open No. 2004-78826, the method of producing functional fiber includes the steps of: making fiber thread discharged through a nozzle after melting raw materials; putting purified water mounted at a nozzle outlet in water tanks; arranging a number of discharge electrodes on a fiber passing through the nozzle in a diagonal direction; supplying electric power in such a fashion that electric power is supplied alternatingly by the water tanks which are in alternating arrangement so that the discharge electrodes are discharged evenly; passing fiber thread through the water tanks so that the fiber thread is bound to fiber.

However, the method of adding nonferrous metals to fiber by discharging the discharge electrodes is a sort of the silver coating method and has several problems in that the process is complicated and inconvenient and production costs are increased. Moreover, the method also has other problems in that it is not easy to coat nonferrous metals to fiber evenly because the arrangement of the discharge electrodes is not even, and in that it is difficult to keep the initial anti-bacterial function as it is because the coated silver may be easily come off during washing since coated silver cannot keep a firm binding force.

Furthermore, Korean Patent No. 542,007 entitled "electrically conductive fabric" discloses a conductive fabric which can prevent back-leak of resin and unwinding of thread and provide flexibility, conductivity and electromagnetic shielding performance by forming a metal film, such as silver, copper, nickel, tin, or others, on a synthetic fiber filament through the electroless plating method. However, the conductive fabric obtained through the plating method also has a problem in that the coated silver may be easily come off during washing, and hence, it is difficult to keep the initial anti-bacterial function as it is.

Conventional methods of producing conductive yarns are divided into a compound yarn method, a coating method, and a metal yarn method (metal pulling), and the conductive yarns are related with smart clothing.

In case of the compound yarn, a conductive material or a metal layer produced by decomposing conductive carbon black is taken as a core and a nonconductive layer is covered on the core, so that at least two layers are formed. Additionally, in order to enhance conductivity of the compound yarn, if necessary, the core is manufactured not in a circle but in one of other shapes.

Moreover, the produced conductive yarn has a problem in that it is difficult to properly operate a digital device mounted on smart clothing because it has an electrical performance still lower than the metal yarn made by pulling work.

Korean patent Laid-open No. 2006-122543 discloses conductive yarns used for smart clothing with electrical insulating property, which covers copper metal yarn and metal yarn having diameters ranging from 0.03 mm to 0.08 mm.

As shown in FIGS. 2 and 3, the copper conductive yarn 2 is covered by thread as a covering yarn 1. The covering yarn 1 may be made of PET, nylon, wool, and so on. Additionally, the copper metal yarn 3 may be three strands of yarn.

The conductive yarn can show the function of general conductive yarns because using the copper metal yarn as thread, but is lower in conductivity than silver and does not have the same anti-bacterial function as a conductive yarn using a silver wire. In addition, the conductive yarn using the copper metal yarn has another problem in that its color is changed easily due to oxidation of copper.

Korean Patent No. 706,669 discloses a silver wire combined with silver powder and a system for producing the silver wire. In Korean Patent No. 706,669, the silver wire is made by the steps of: coating silver powder on the surface of thread serving as a core yarn while covering or plying one strand or two strands of thread through a covering machine; and covering the thread with another thread. The silver wire is made by coating the surface of thread with silver particles and covering the coated thread with another thread to thereby prevent the silver particles from being come off.

Such a coated yarn is a conductive yarn that a conductive material is coated on the surface of a nonconductive material and has better conductivity than nonconductive materials, but has a problem in that it is lower in conductivity than metal wires and is low in durability and price competitiveness because it is coated with copper.

Korean Patent No. 688,899 discloses a conductive plied metal yarn and a method of producing the same. In Korean Patent No. 688,899, the conductive plied metal yarn is made by covering and twisting a plurality of conductive materials on the surface of a fiber yarn in such a way as to be large in number of twist and plying and twisting the twisted yarns.

Such a compound yarn is high in tensile strength and provides good electromagnetic shielding performance because using a great deal of metal wires per unit length even though the used amount is different according to weaving forms and used metals. However, the required length of the compound yarn per unit length is increased, resistance is increased. Moreover, if resistance is increased, there may occur a signal distortion when the compound yarn is used as a fabric signal line (conductive yarn or digital yarn) for smart clothing.

Because metal wires generally provides good characteristics as resistance is low, metal wires with a large cross-sectional area show good characteristics, but considering a wear sensation and production costs of fabrics obtained using the metal wires, metal wires with a small cross-sectional area are better than those with large cross-sectional area. Accordingly, in order to provide a good wear sensation and enhance conductivity, metals with high conductivity must be made into fine wires.

DISCLOSURE

Technical Problem

The conventional methods, such as the thread mixing method, the coating method, and the method of producing conductive yarns, have problems in that they cannot show the inherent characteristics of silver, in that coating work is complicated and additional inconvenient processes are needed, or in that electrical performance is remarkably deteriorated.

Accordingly, the present invention has been made in an effort to solve the above-mentioned problems occurring in the prior arts, and it is an object of the present invention to provide a silver wire, a plied silver yarn, a functional fabric using the same, and a manufacturing method of the same, which can provide a good wear sensation (flexibility) as a fine and soft fiber because taking not a coated yarn or a flat yarn but a silver (Ag) fine wire with a uniform diameter of less than 0.05 mm through a pulling process, which is the metal processing technology, as a core yarn or a covering yarn, and which can be used as an anti-bacterial yarn or a digital yarn (conductive yarn) for smart clothing because having good anti-bacterial effect and conductivity.

It is another object of the present invention to provide a silver wire, a plied silver yarn, a functional fabric using the same, and a manufacturing method of the same, which can provide electromagnetic shielding effect and anti-static effect because the plied silver yarn has the inherent characteristics of silver (Ag).

Technical Solution

To achieve the above objects, the present invention provides a silver wire that is at least one strand of wire produced by casting silver (Ag) or a silver alloy into a wire rod through directional solidification and making the wire rod into a microfiber having a diameter ranging from 0.015 mm to 0.05 mm through a pulling process, is used for plied silver yarns, and has anti-bacterial effect and conductivity.

In another aspect of the present invention, the present invention provides a plied silver yarn that is produced by taking any one of at least one strand of a silver wire or a fiber yarn, which is made from natural fiber or synthetic fiber, as a core yarn and taking the other one as a covering yarn to cover the core yarn, wherein the silver wire is produced by casting silver (Ag) or a silver alloy into a wire rod through directional solidification and making the wire rod into a microfiber having a diameter ranging from 0.015 mm to 0.05 mm through a pulling process.

In a further aspect of the present invention, the present invention provides a plied silver yarn that is produced by twisting and plying at least one strand of a silver wire with a fiber yarn, which is made from natural fiber or synthetic fiber, wherein the silver wire is produced by casting silver (Ag) or a silver alloy into a wire rod through directional solidification and making the wire rod into a microfiber having a diameter ranging from 0.015 mm to 0.05 mm through a pulling process.

Moreover, the natural fiber is made from at least one of traditional Korean paper, polylactic acid (PLA), cotton, hemp, wool, and silk. Furthermore, the synthetic fiber is made from at least one of nylon, polyester, polyvinyl chloride, polyacrylonitrile, polyamide, polyolefin, polyurethane, and Polyfluoroethylene.

In a still further aspect of the present invention, the present invention provides a method of producing a plied silver yarn including the steps of: (a) preparing a silver wire that is produced by casting silver (Ag) or a silver alloy into a wire rod through directional solidification and making the wire rod into a microfiber having a diameter ranging from 0.015 mm to 0.05 mm through a pulling process; and (b) obtaining a first plied silver yarn by taking any one of at least one strand of the silver wire obtained through the step (a) or a fiber yarn, which is made from natural fiber or synthetic fiber, as a core yarn and taking the other one as a covering yarn to cover the core yarn.

The method of producing the plied silver yarn further includes the step of producing a second plied silver yarn by taking the first plied silver yarn plied after the step (b) as thread and covering the first plied silver yarn with a fiber yarn, which is made from natural fiber or synthetic fiber.

In this instance, the silver wire is made with a silver alloy that contains copper (Cu) of 0.1 wt % to 10 wt % and silver (Ag) of 90 wt % to 99.9 wt %.

In another aspect of the present invention, the present invention provides a functional fabric that is obtained by weaving a plied silver yarn using a circular knitting machine (knitting machine), wherein the plied silver yarn is produced by taking any one of at least one strand of a silver wire or a fiber yarn as a core yarn and taking the other one as a covering yarn to cover the core yarn, and wherein the silver wire is produced by casting silver (Ag) or a silver alloy into a wire rod through directional solidification and making the wire rod into a microfiber having a diameter ranging from 0.015 mm to 0.05 mm through a pulling process.

Advantageous Effects

The plied silver yarns according to the present invention obtain permanent anti-bacterial effect and conductivity because being manufactured by plying and twisting a silver fine wire, which are threads, with a fiber yarn made of natural fiber or synthetic fiber, by covering the silver fine wire with the fiber yarn, or by taking the fiber yarn as a core yarn and covering the fiber yarn with a silver wire.

Moreover, the present invention can be used as digital yarns (conductive yarns) to anti-bacterial yarns, smart clothing, and others due to antibacterial effect and conductivity because keeping inherent characteristics of silver (Ag) as they are, and is highly effective in preventing electromagnetic waves and static electricity.

MODE FOR INVENTION

Reference will be now made in detail to the preferred embodiment of the present invention with reference to the attached drawings.

Figure 1:
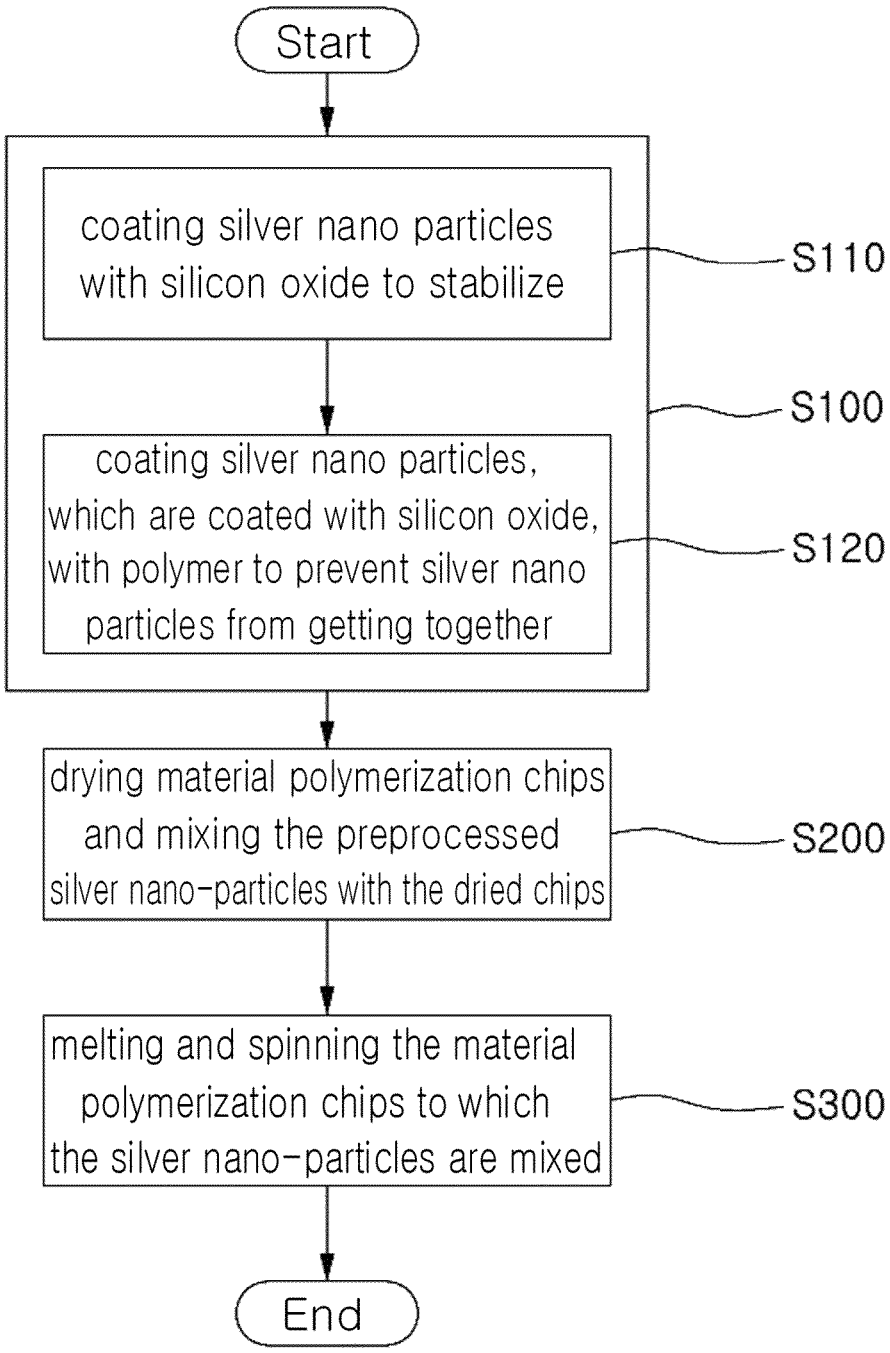
FIG. 1 Prior Art
FIG. 1 is a flow chart showing a process of manufacturing silver nano synthetic fibers according to a prior art.
Figure 2:
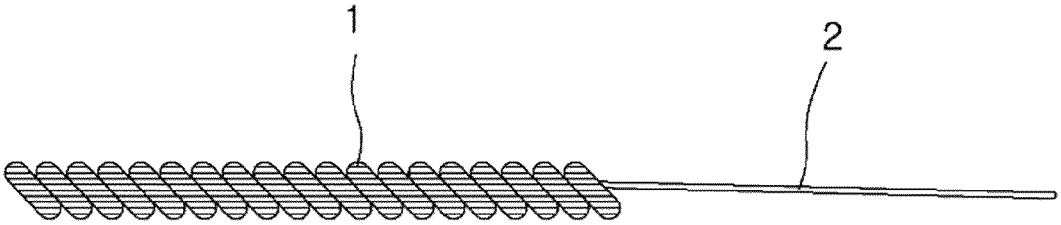
FIG. 2 Prior Art
FIGS. 2 and 3 are views showing conductive yarns according to prior arts.
Figure 3:
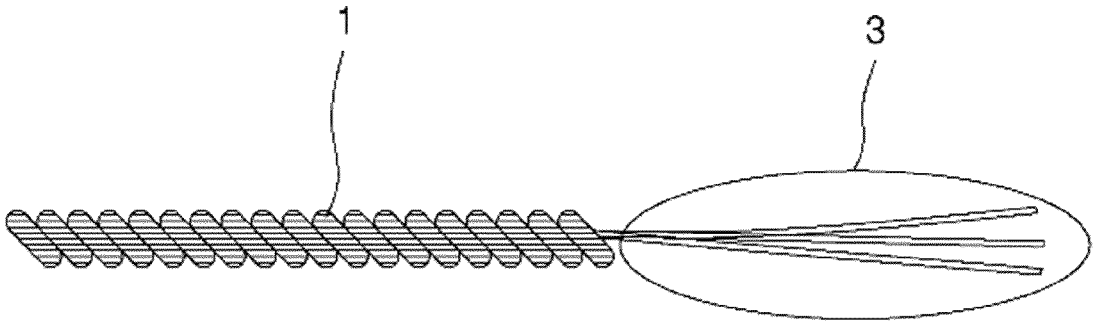
FIG. 3 Prior Art
Figure 4:
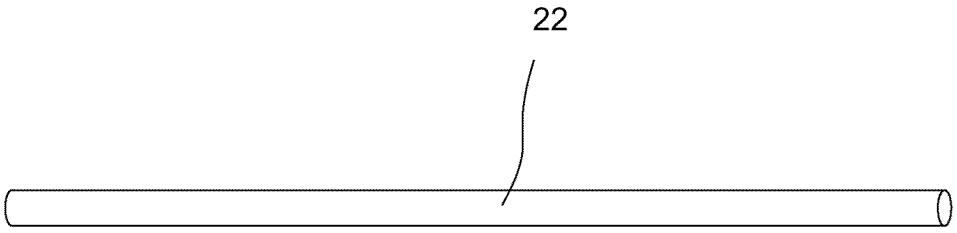
FIG. 4 is a perspective view of a silver wire according to the present invention.
Figure 5:
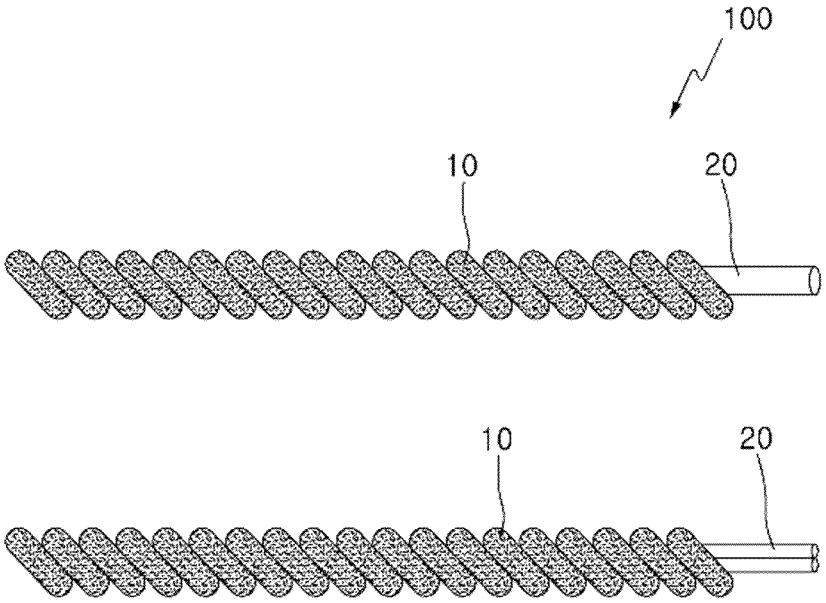
FIG. 5 is a perspective view of a plied silver yarn taking the silver wire as a core yarn according to a first preferred embodiment of the present invention.
Figure 6:
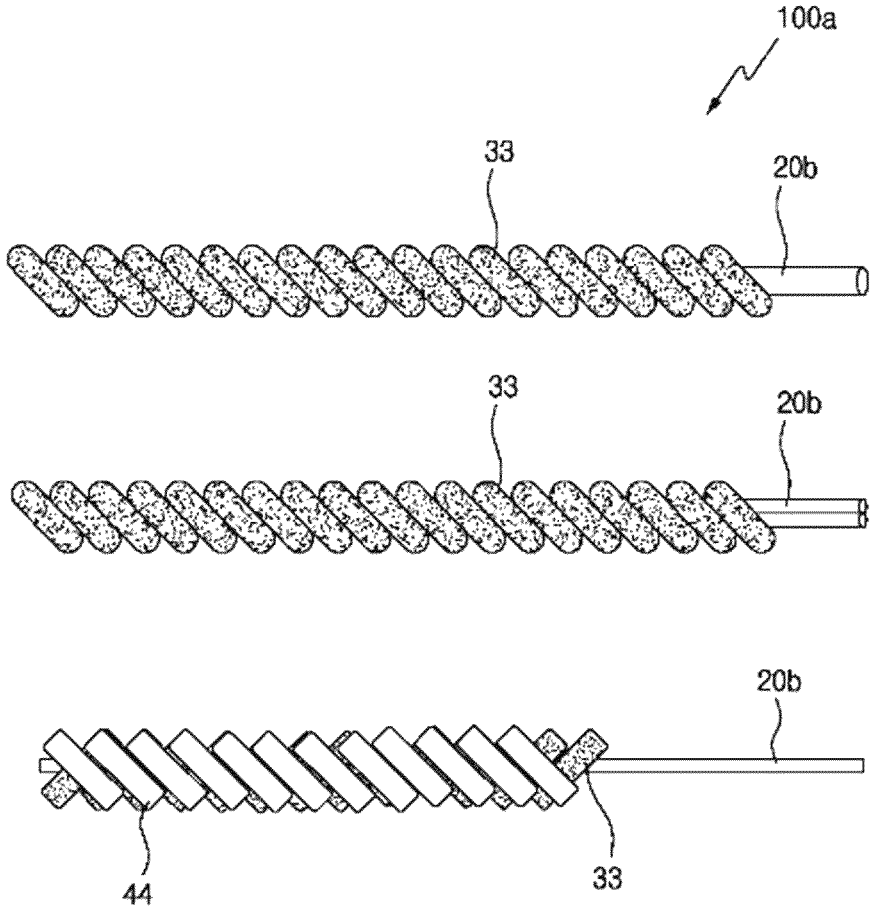
FIG. 6 is a perspective view of a plied silver yarn taking a fiber yarn as a core yarn according to a second preferred embodiment of the present invention.
Figure 7:
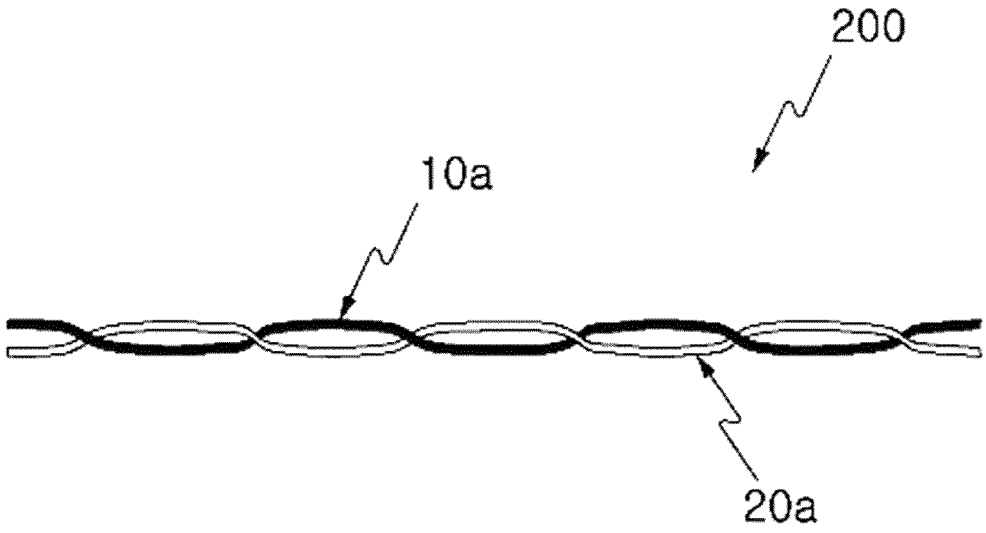
FIG. 7 is a perspective view of a plied silver yarn formed by plying the silver wire and the fiber yarn according to a third preferred embodiment of the present invention.
Figure 8:
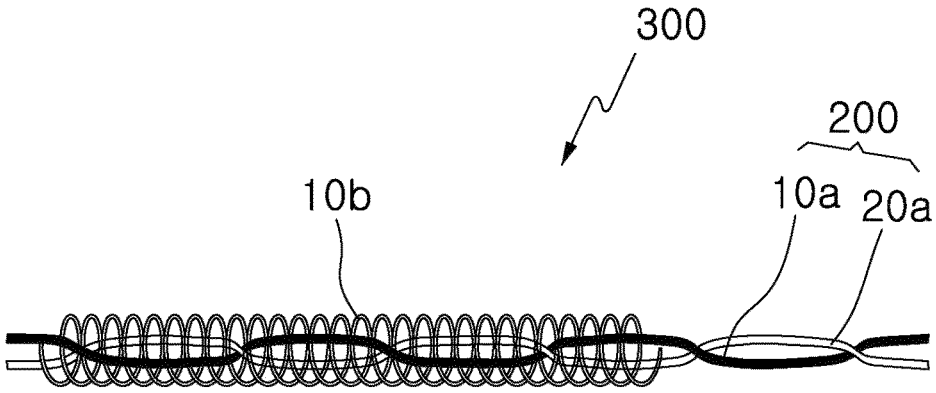
FIG. 8 is a schematic view showing a covering yarn taking the plied silver yarn of FIG. 7 according to a fourth preferred embodiment of the present invention.

FIG. 4 is a perspective view of a silver wire according to the present invention, FIG. 5 is a perspective view of a plied silver yarn taking the silver wire as a core yarn according to a first preferred embodiment of the present invention, FIG. 6 is a perspective view of a plied silver yarn taking a fiber yarn as a core yarn according to a second preferred embodiment of the present invention, FIG. 7 is a perspective view of a plied silver yarn formed by plying the silver wire and the fiber yarn according to a third preferred embodiment of the present invention, and FIG. 8 is a schematic view showing a covering yarn taking the plied silver yarn of FIG. 7 according to a fourth preferred embodiment of the present invention.

As shown in FIG. 5, the plied silver yarn 100 according to the first preferred embodiment of the present invention takes at least one strand of a silver wire 22 (see FIG. 4) as a core yarn 20 and also takes a fiber yarn made from natural fiber or synthetic fiber as a covering yarn (winding yarn) 10, wherein the silver wire is produced by casting 99.9 percent pure silver (Ag) or a silver-copper alloy into a wire rod through directional solidification and making the wire rod into a microfiber having a diameter ranging from 0.015 mm to 0.05 mm through a pulling process.

Furthermore, as shown in FIG. 6, the plied silver yarn **100*a* according to the second preferred embodiment of the present invention takes a fiber yarn made from natural fiber or synthetic fiber as a core yarn 20*b* and also takes a silver wire 22 as the first covering yarn (winding yarn) 33, and then, covers the silver wire 22 with another fiber yarn 44**, wherein the silver wire is produced by casting 99.9 percent pure silver (Ag) or a silver-copper alloy into a wire rod through directional solidification and making the wire rod into a microfiber having a diameter ranging from 0.015 mm to 0.05 mm through a pulling process.

First, silver alloy microfiber having a diameter ranging from 50 μm to 70 μm, for instance, can be obtained by a method of producing a silver alloy fine wire disclosed in Korean Patent No. 879815 that had been invented by the same inventor as the present invention.

The silver alloy fine wire is produced by casting a silver alloy, which contains copper (Cu) of 0.1 wt % to 10 wt % and silver (Ag) of 90 wt % to 99.9 wt %, into a silver alloy wire rod in such a fashion that the grain boundary is arranged horizontally relative to a pulling direction by the directional solidification and pulling the silver alloy wire rod into a microfiber having the diameter ranging from 15 μm to 50 μm.

The silver alloy fine wire has silver (Ag) for its main ingredient and contains copper (Cu) of 0.1 wt % to 10 wt % to make the fine wire processing easy, and hence, the silver alloy can be processed into the fine wire easier than pure silver (Ag).

In the meantime, in case of pure silver, the widely-known technology of producing silver fine fiber cannot make superfine wires having a diameter of less than 0.07 mm, and even if it is possible, cannot produce long fibers and is deteriorated in work stability due to a high burnout rate.

Additionally, in case that the fine wire has a diameter of more than 0.05 mm, it is difficult to use it as thread for plied yarns because it is not as flexible as fiber due to stiffness of metals.

Moreover, due to the limitations of the conventional technology of producing pure silver or silver alloy fine wires, it has been considered to use relatively thicker wires, but it requires lots of materials expenses since using a great deal of silver and decreases the anti-bacterial function in proportion to the diameter.

Silver wire can secure a wider surface area with small quantity as being a fine wire, and as a result, increase the anti-bacterial function, which is the property of silver. If a silver wire of more than 70 μm is used, it requires a relatively large quantity of silver compared with the anti-bacterial effect.

The silver alloy fine wire obtained by the technology disclosed in Korean Patent No. 879815 cannot produce fine fiber having a diameter of less than 0.05 mm, but the inventor of the present invention could complete the present invention by producing a silver wire 22 having a diameter ranging from 0.015 mm to 0.05 mm, which would be used as thread, through an improved technology of producing silver superfine wires.

Furthermore, the silver wire 22 used in the present invention can be processed into a superfine wire of the diameter ranging from 0.015 mm to 0.05 mm, and any kind of silver alloy having anti-bacterial function and conductivity is usable to the present invention.

Accordingly, in the present invention, the silver wire 22 of the diameter ranging from 0.015 mm to 0.05 mm is made with 99.99 percent pure silver besides the silver alloy and used as a core yarn, a thread, or a covering yarn.

The silver wire 22 may have at least one strand of thread according to uses of fabrics or knitted goods made form plied yarns.

The silver wire 22 must have flexibility in order to be used as a fiber. If the silver wire 22 has a diameter or more than 0.05 mm, it is stiff like metals. Accordingly, in order to provide flexibility to the silver wire 22 like fiber, it is preferable that the silver wire 22 has a diameter of less than 0.05 mm. That is, if the silver wire 22 gets larger in diameter, an amount of silver (Ag) used is increased but its anti-bacterial effect is decreased. Accordingly, the silver wire 22 having the large diameter requires more silver (Ag) in order to show the same anti-bacterial effect, and it causes an increase of price.

In addition, current technology makes it difficult to make the diameter of the silver wire 22 less than 0.015 mm, and if the silver wire 22 is too thin, it may break when a plied yarn is made using the silver wire 22 because the silver wire 22 is too weak. Therefore, it is preferable that the diameter of the silver wire 22 is within a range of 0.015 mm to 0.05 mm.

The core yarn 20 and 20*b* and the covering yarn 33 may be the silver wire 22 or a fiber yarn made from natural fiber or synthetic fiber.

The natural fiber may be fiber made from one of, for instance, traditional Korean paper, polylactic acid (PLA), cotton, hemp, wool, and silk.

The synthetic fiber may be fiber made from one of, for instance, nylon, polyester, polyvinyl chloride, polyacrylonitrile, polyamide, polyolefin, polyurethane, and Polyfluoroethylene.

Moreover, the synthetic fiber may be fiber obtained by using one of the following polymers:

polyethylene-based resin, for instance, low-density polyethylene (LDPE), very low-density polyethylene (LLDPE), high-density polyethylene (HDPE), ethylene-vinyl acetate (EVA), and copolymers thereof;

polystyrene-based resin, for instance, HIPS, GPPS, SAN, and so on;

polypropylene-based resin, for instance, HOMO PP, RANDOM PP, and copolymers thereof;

transparent or general ABS (acrylonitrile-butadiene-styrene terpolymer);

hard PVC; and engineering plastics, for instance, nylon, PRT, PET, POM (acetal), PC, urethane, powder resin, PMMA, PES, and so on.

Furthermore, the natural fiber or the synthetic fiber may be one of other well-known fibers as well as the above-mentioned fiber materials.

Meanwhile, as shown in FIG. 7, the first plied yarn 200 having anti-bacterial effect and conductivity according to the third preferred embodiment of the present invention may be produced through the steps of: casting silver or a silver alloy into a wire rod through directional solidification; making the wire rod into a silver wire having a diameter ranging from 0.015 mm to 0.05 mm through the pulling process as the first core yarn 20*a*; taking a fiber yarn made from natural fiber or synthetic fiber as a second core yarn 10*a* and plying the silver wire with the second core yarn 10*a*; and twisting them with each other using a twisting machine.

In this instance, the natural fiber or the synthetic fiber used for the second core yarn 10*a* is identical or similar to that used in the first and second preferred embodiments.

Figure 9:
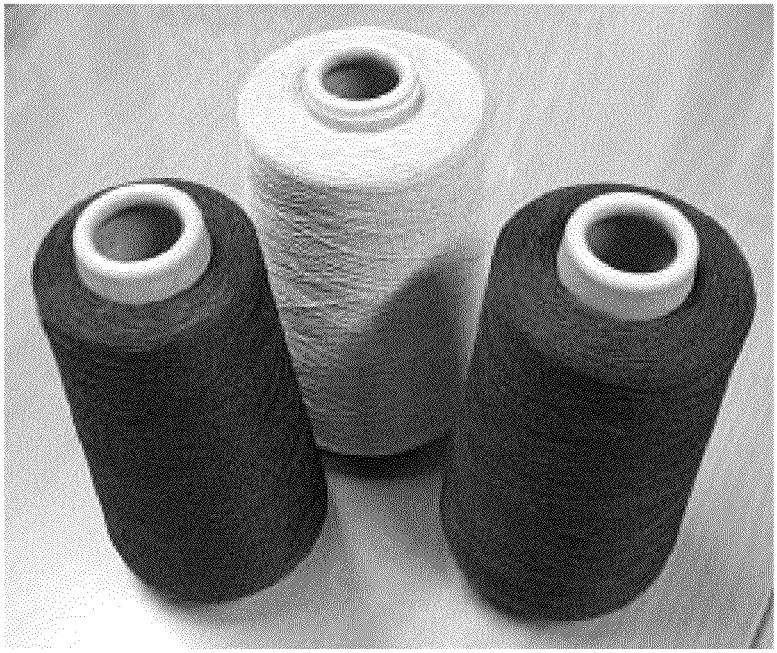
FIG. 9 is a photograph showing a state where the plied silver yarn in which the silver wire is impregnated is wound on a rod.

Moreover, as shown in FIG. 8, the plied silver yarn of the fourth preferred embodiment takes the first plied yarn 200 (see FIG. 7), which is obtained by plying a silver wire with a fiber yarn made from natural fiber or synthetic fiber, as the core yarn and takes a fiber yarn, which is made from natural fiber or synthetic fiber, as a covering yarn 10*b*. The plied silver yarn according to the fourth preferred embodiment is produced by covering the first plied yarn 200 with the covering yarn 10*b* to obtain a second plied yarn 300 and dyeing the second plied yarn 300, so that a functional fiber with a wanted color can be obtained (see FIG. 9).

Additionally, using the plied yarn according to the present invention, a woven fabric may be made by weaving warp threads running up and down and weft threads running sideways and going over one warp thread and under the next to form a fabric of a certain width, and a knitted fabric may be made by making interlocking loops of yarn in such a fashion as to make a loop of yarn and create a new loop by holding the yarn to the existing loop.

Figure 10:
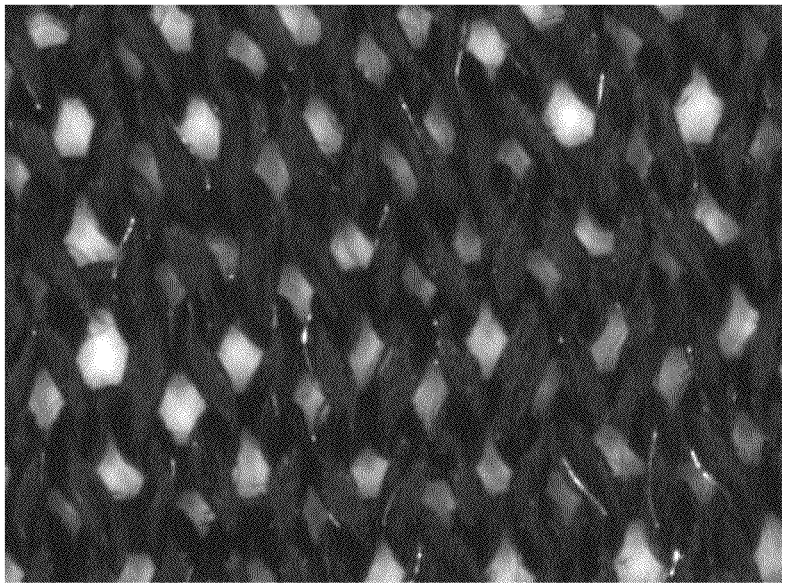
FIG. 10 is an enlarged photograph of a fabric manufactured using the plied yarn according to the present invention.

In the present invention, as shown in FIG. 10, a knit, which is a functional fabric, was produced using the plied silver yarn, and a woven fabric may be also produced using the plied silver yarn.

The functional fabric of the present invention produced as described above is applicable to all textile goods requiring anti-bacterial effect and conductivity, for instance, socks, insoles, towels, aprons, kitchen towels, bed coverings, cushion coverings, and functional fibers, digital fibers and smart fibers requiring conductivity, and so on.

Hereinafter, the preferred embodiments of the present invention will be described in more detail.

Embodiment 1

Pure silver (Ag) was melted using a horizontal continuous casting machine with a heated mold, and a rod with a diameter of 9 mm having a one-way structure was casted. The casted rod was made into a silver wire with a diameter of 40 μm through a sequential pulling work in a rod break-down drawing machine, a medium wire drawing machine, a wire drawing machine, and a fine wire drawing machine. A plied yarn was produced by mixing the silver wire, traditional Korean paper and PLY, which is a fiber made of cornstarch. First, one strand of 120 denier silver wire (20 denier in appearance) and one strand of 177 denier traditional Korean paper were twisted into 350T/M. The produced plied yarn was covered with two strands of 75 denier PLA, which was fiber made from cornstarch, so that 347 denier plied yarn was finally produced. The plied yarn was finally dyed with navy color through a dyeing process.

Embodiment 2

Like the first embodiment of the present invention, pure silver (Ag) was melted using a horizontal continuous casting machine with a heated mold, and a rod with a diameter of 9 mm having a one-way structure was casted. The casted rod was made into a silver wire with a diameter of 40 μm through a sequential pulling work in a rod break-down drawing machine, a medium wire drawing machine, a wire drawing machine, and a fine wire drawing machine. A plied yarn was produced by mixing the silver wire, traditional Korean paper and PLY, which is a fiber made of cornstarch. First, one strand of 120 denier silver wire (20 denier in appearance) and one strand of 177 denier traditional Korean paper were twisted into 350T/M. The produced plied yarn was covered with one strand of 75 denier PLA, which was fiber made from cornstarch, and on strand of 89 denier cotton so that 361 denier plied yarn was finally produced. The plied yarn was finally dyed through a dyeing process.

Embodiment 3

A fabric was made by knitting the plied yarns produced through the first and second embodiments using a 12-gauge knitting machine (circular knitting machine) in case of 1 ply yarn and using a 7-gauge knitting machine in case of 2 ply yarn. FIG. 10 shows the fabric obtained through the third embodiment of the present invention.

(Anti-Bacterial Test)

As a result of test on the anti-bacterial function of a specimen obtain through the third embodiment using staphylococcus aureus ATCC 6538 (pyogenic bacteria) as test bacteria (Test method: KS K 0693), when the fiber obtained through the third embodiment was added to a culture medium after a lapse of 18 hours from the time that the bacteria was inoculated to the culture medium, a decrease percent of the number of bacteria was more than 99.9%.

(Conductivity Test)

The plied yarns produced through the first and second embodiments were tested in conductivity. In order to test conductivity, INSTEK GOM-802 (Resistance tester) was used. First, the plied yarn of 50 cm in length was measured, and then, resistance was measured after terminals were connected to both ends of the plied yarn. In order to reduce errors, the test was carried out seven times. As a result that the tested electrical conductivity was converted into IACS (International Annealed Copper Standard), in which electrical conductivity of pure copper is 100%, the plied yarn showed a high electrical conductivity of 106.6%. (for your reference, pure copper of 100%, and silver-coated pure copper of 100%)

The plied yarn made by plying and twisting the silver wire with the fiber yarn, which is made from natural fiber or synthetic fiber, and another plied yarn made by covering the silver wire or the plied yarn with a fiber yarn, and the knitted fabric obtained using one of the plied yarns are described in the above embodiments, but other woven fabrics or knitted fabrics may be made through the known weaving methods using the plied yarns produced according to the present invention.

INDUSTRIAL APPLICABILITY

As described above, the silver wire, the plied silver yarn, functional fabrics (fibers) using the same, and plied yarns and textiles obtained through the method for producing the same are widely usable to various fields, such as apparel fields, various textile fields such as industrial and mass-consumptive fabrics, and nonwoven fabrics, and clothing fields, because having anti-bacterial effect, sterilization, anti-electromagnetic radiation, and anti-static effect.

The invention claimed is:

1. A method of producing a plied silver yarn, comprising the steps of:

(a) preparing a silver wire that is produced by casting silver or a silver alloy into a wire rod through directional solidification and making the wire rod into the silver wire having a diameter ranging from 0.015 mm to 0.05 mm through a pulling process;

(b) obtaining a first plied silver yarn by plying at least one strand of the silver wire with a fiber yarn made from natural fiber or synthetic fiber, and twisting the silver wire and the fiber yarn to form the first plied silver yarn; and (c) producing a second plied silver yarn by taking the first plied silver yarn as a core yarn and winding a second fiber yarn as a covering yarn around the first plied silver to form the second plied silver yarn, the second fiber yarn being formed of natural fiber or synthetic fiber.

2. The method according to claim 1, wherein the natural fiber is made from at least one of traditional Korean paper, polylactic acid (PLA), cotton, hemp, wool, and silk.

3. The method according to claim 1, wherein the synthetic fiber is made from at least one of nylon, polyester, polyvinyl chloride, polyacrylonitrile, polyamide, polyolefin, polyurethane, and Polyfluoroethylene.

4. The method according to claim 1, wherein the silver alloy contains copper of 0.1 wt % to 10 wt % and silver of 90 wt % to 99.9 wt %.

* * * * *